US006711820B2

(12) United States Patent
Chen

(10) Patent No.: US 6,711,820 B2
(45) Date of Patent: Mar. 30, 2004

(54) TRANSFORMABLE POCKET KNIFE

(75) Inventor: Chia-Lung Chen, Hinsdale, IL (US)

(73) Assignee: Linksmart, Inc., Hinsdale, IL (US)

( * ) Notice: Subject to any disclaimer, the term of this patent is extended or adjusted under 35 U.S.C. 154(b) by 63 days.

(21) Appl. No.: 10/036,948

(22) Filed: Dec. 21, 2001

(65) Prior Publication Data

US 2003/0115758 A1 Jun. 26, 2003

(51) Int. Cl.[7] ..... B26B 11/00
(52) U.S. Cl. ..... 30/122; 30/161; 30/255
(58) Field of Search ..... 30/122, 199, 254, 30/255, 340, 341, 160, 161, 260; 81/177.7, 177.8

(56) References Cited

U.S. PATENT DOCUMENTS

| | | | | | |
|---|---|---|---|---|---|
| 1,439,507 | A | * | 12/1922 | Delsing | 30/161 |
| 1,524,694 | A | * | 2/1925 | Di Maio | 30/122 |
| 2,198,539 | A | * | 4/1940 | Klopfer | 30/161 |
| 2,952,912 | A | * | 9/1960 | Crawford | 30/255 |
| 3,766,648 | A | * | 10/1973 | Chundelak, Jr. | 30/255 |
| 4,744,272 | A | * | 5/1988 | Leatherman | 30/122 |
| 5,327,651 | A | * | 7/1994 | Favreau | 30/161 |
| 5,357,678 | A | * | 10/1994 | Wei | 30/255 |
| 5,722,171 | A | * | 3/1998 | Schmidt | 30/255 |
| 6,220,127 | B1 | | 4/2001 | Berg et al. | 81/427.5 |
| 6,249,976 | B1 | * | 6/2001 | Osame | 30/199 |
| 6,273,582 | B1 | | 8/2001 | Taggart et al. | 362/119 |
| 6,282,997 | B1 | | 9/2001 | Frazer | 81/427.5 |
| 6,286,745 | B1 | | 9/2001 | Ackeret | 227/76 |
| 6,289,592 | B1 | | 9/2001 | Emerson | 30/161 |

* cited by examiner

*Primary Examiner*—Hwei-Siu Payer
(74) *Attorney, Agent, or Firm*—Welsh & Katz, Ltd.

(57) ABSTRACT

The cutting tool, or folding scissors, has first and second knife blades and first and second handles, each of the first and second knife blades and first and second handles being positionable relative to one another. The knife blades and handles effect at least a scissors cutting function in at least one open position of the tool. In particular, the first and second knife blades and the first and second handles effect the scissors cutting function in each of a plurality of open positions of the tool. The tool also has a locking assembly that locks the first knife blade and first handle in at least one first position and that locks the second knife blade and the second handle in at least one second position, independently of the first knife blade and first handle. Combinations of the first and second positions respectively define the open positions of the tool. For multiple open positions the locking assembly locks the first and second knife blades and the first and second handles in different first and second positions.

34 Claims, 8 Drawing Sheets

FIG. 2
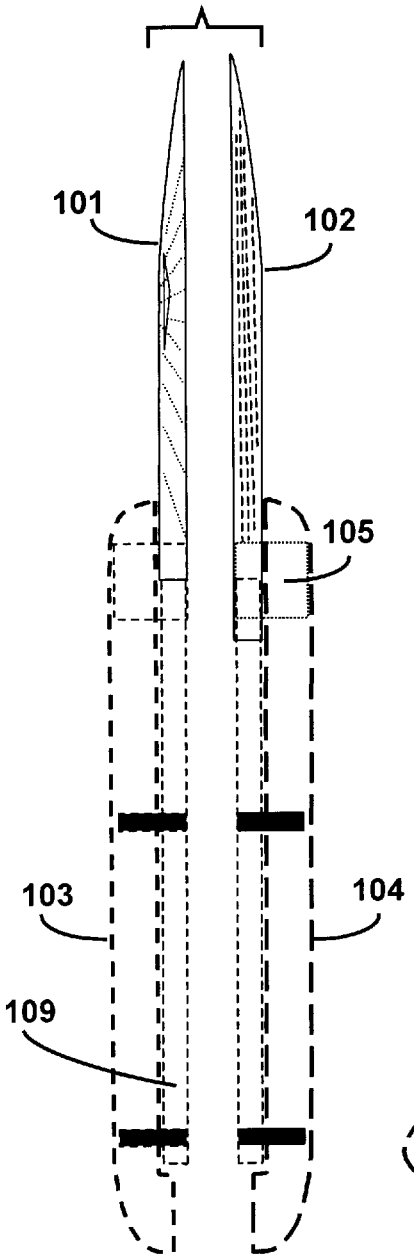
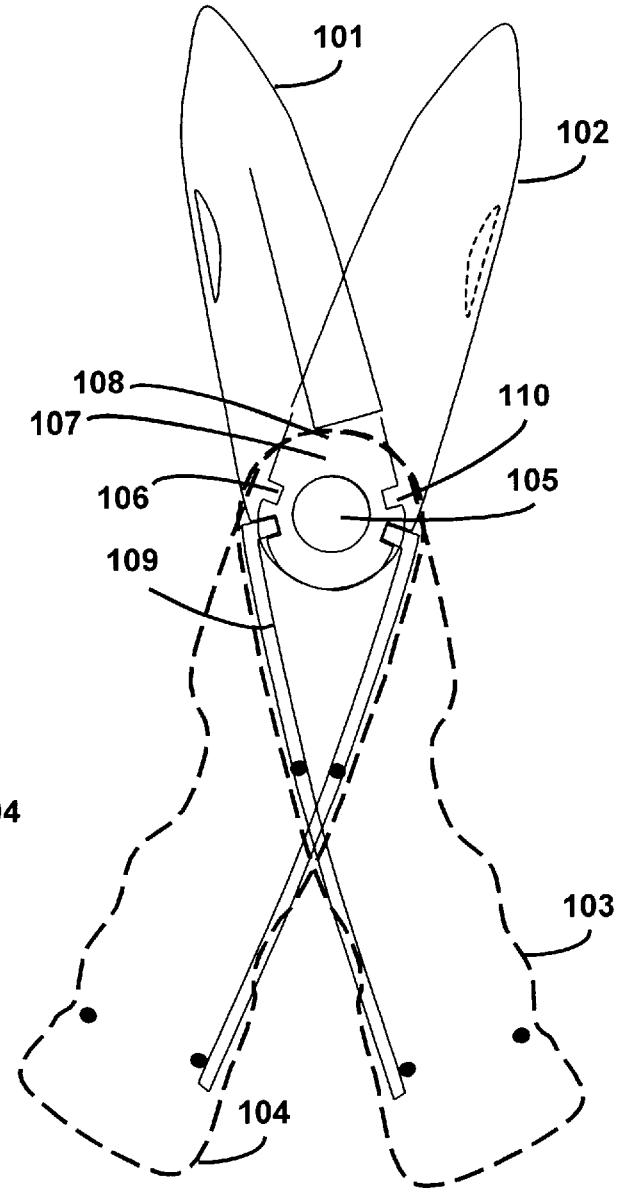
FIG. 1
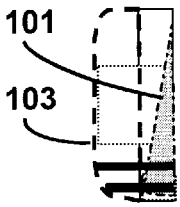
FIG. 3
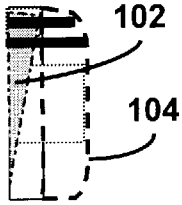
FIG. 4

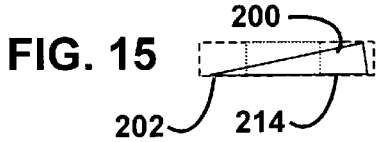
FIG. 15
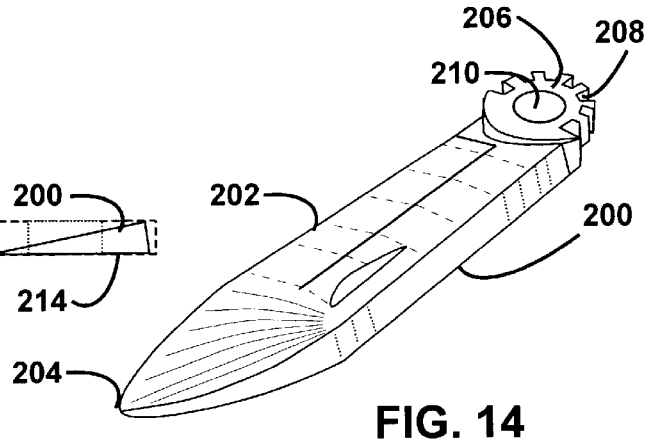
FIG. 14
FIG. 19
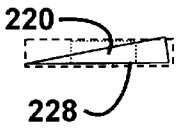
FIG. 21
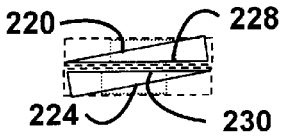
FIG. 20
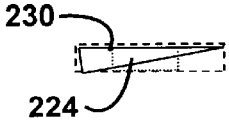
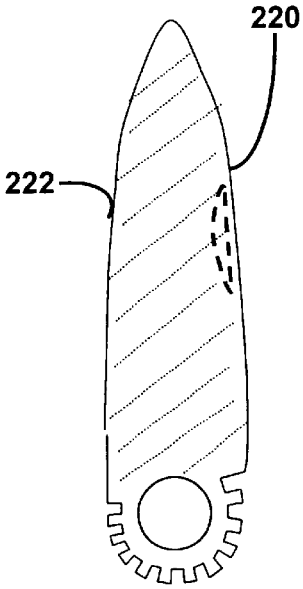
FIG. 16
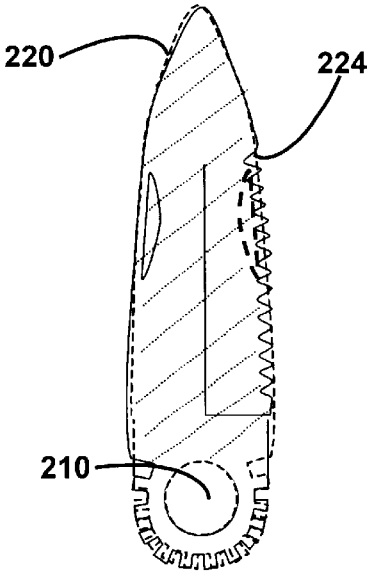
FIG. 18
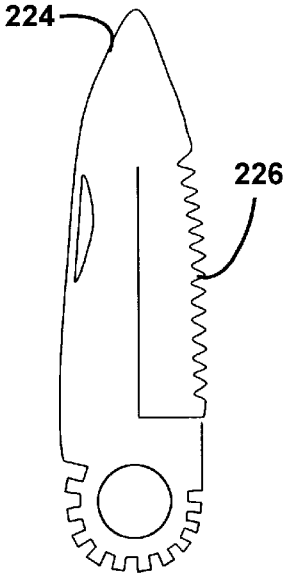
FIG. 17

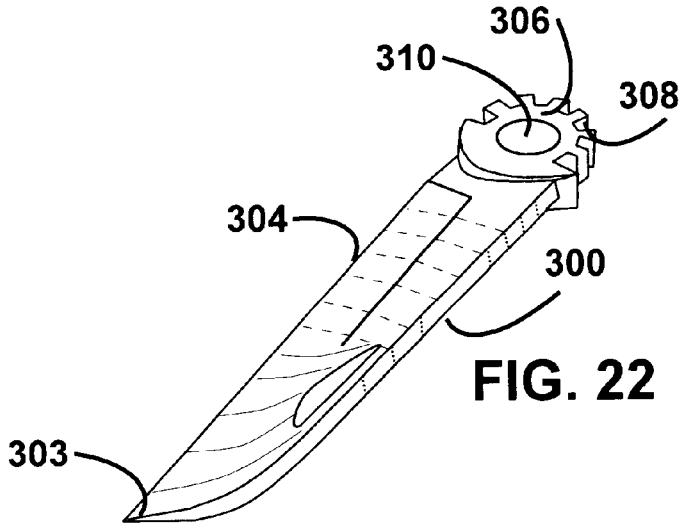
FIG. 22
FIG. 26
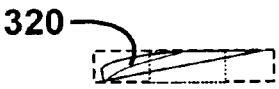
FIG. 27
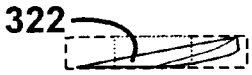
FIG. 28
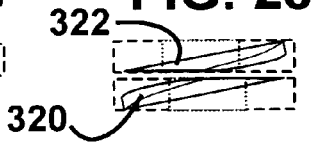
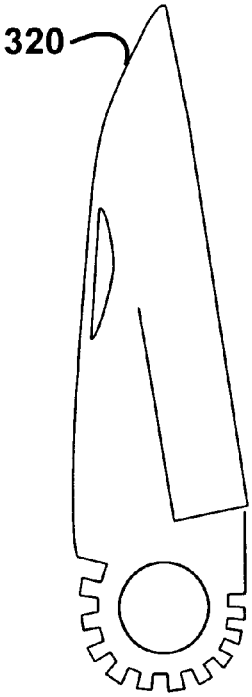
FIG. 23
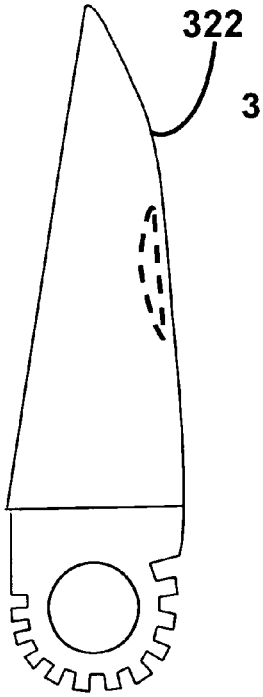
FIG. 24
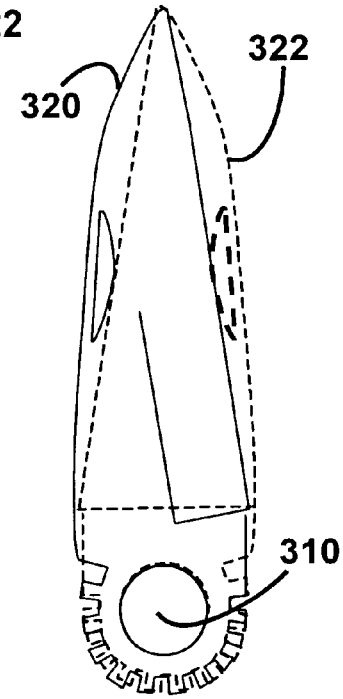
FIG. 25

TRANSFORMABLE POCKET KNIFE

FIELD OF THE INVENTION

The present invention relates, in general, to cutting tools, and in particular to tools which can be folded into a compact arrangement for easy transportation.

BACKGROUND OF THE INVENTION

Numerous types of tools, which fold into compact forms, are well known. For example, one type of tool is a folding knife having a releasable lock for holding the knife blade in an open position and for holding the blade in a closed position. In the closed position the cutting edge is housed in a knife handle. Such knifes may have one or more blades and may have other folding tools such as files, saw blades, scissors etc. A locking device is often provided to hold the knife or other tool in a fully open usable position. This locking mechanism or other device is also used to lock the knife or tool into a stored position typically inside the handle of the instrument.

Another tool is a multiple function combination business travel tool in which one of the tools is a scissors. This tool includes the first handle having a first implement channel and a first scissors channel, and a second handle having a second implement channel and a second scissors channel. First and second scissors blades are mounted respectively to the first and second handles at first and second axis, respectively. A scissors fulcrum axis rotatably mounts the first scissors blade to the second scissors blade. The first and second scissors blades are contained within the first and second scissors channels in an undeployed configuration. When the scissors blades are deployed, the first and second scissors blades are rotated about the first and second axis, respectively. This scissors tool is representative of those in the art and is deployable into only a single operating position. It is also to be noted that the axis for the blades is different than that for the attachment of the blades to the respective handles.

Although known types of the folding scissors are useful for certain applications, they have major disadvantages in that they are typically bulky and clumsy to use in that they do not have a normal scissors configuration. In addition it is a drawback of the prior art folding scissors that the scissors have only one open orientation. Different types of cutting functions require that the handles have different angles with respect to the blades.

Thus there exists a need for an improved folding scissors, which provides ease of use with a selectable range of positions of the handles relative to the scissors or knife blades.

SUMMARY OF THE INVENTION

One embodiment of the present invention is a cutting tool, or folding scissors, which has first and second knife blades and first and second handles. One feature is that each of the first and second knife blades and first and second handles may be positionable relative to one another. The knife blades and handles thus may effect at least the scissors cutting function in at least one open position of the tool. In particular the first and second knife blades and the first and second handles effect the scissors cutting function in each of a plurality of open positions of the tool. The tool also may have a locking assembly that locks the first knife blade and first handle in at least one first position and then locks the second knife blade and the second handle in at least one second position independently of the first knife blade and first handle. The first and second positions define the open positions of the tool. For multiple open positions the locking assembly locks the first and second knife blades and the first and second handles in different first and second positions.

In another embodiment of the present invention, the first and second knife blades and the first and second handles may all be attached at a common pivot axis. Thus the inventive tool overcomes the drawbacks of the prior art and provides a tool that is simple and straightforward to use, and that operates similar to non-folding type scissors.

Furthermore the cutting tool of the present invention can be adjusted for different types of cutting operations by changing the position of the handles relative to the knife blades.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the company drawings, in the several figures of which like reference numerals identify like elements, and in which:

FIG. 1 is a front view of one embodiment of a folding scissors.

FIG. 2 is an exploded side view showing a specific embodiment of a folding scissors in an open or deployed position.

FIGS. 3 and 4 are cross sectional views of a specific example of the handles and respective blades depicted in FIG. 2.

FIG. 14 is a perspective view of an embodiment of a blade suitable for the scissors of FIGS. 1–13, which has a flat surface on one side thereof.

FIG. 15 is a cross sectional view of the FIG. 14 blade.

FIGS. 16, 17 and 18 are views of an example of a first blade depicted in FIG. 16, a second blade depicted in FIG. 17 and both blades depicted in FIG. 18.

FIGS. 19, 20 and 21 are a cross section of views of FIGS. 16, 17 and 18, respectively.

FIG. 22 is a perspective view of an alternative embodiment of a blade for use in the scissors illustrated in FIGS. 1–19.

FIGS. 23, 24 and 25 depict views of the FIG. 22 alternative blade in which FIG. 23 is a first blade, FIG. 24 depicts a second blade and FIG. 25 depicts both blades together.

FIGS. 26, 27 and 28 are cross sectional views of the blades depicted in FIGS. 23, 24 and 25.

DETAILED DESCRIPTION OF THE INVENTION

Figure 5:
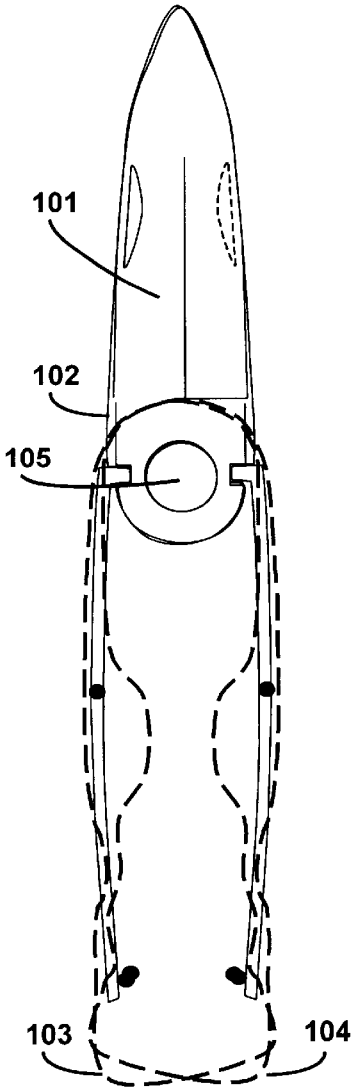
FIGS. 5, 6 and 7 are side views depicting embodiments of folding scissors with both blades deployed in FIG. 5, with only one blade deployed in FIG. 6, and with both blades in the closed position and contained within the handles in FIG. 7.

One embodiment of a folding scissors is depicted in FIG. 1. The folding scissors has a first blade 101, a second blade 102, a first handle 103 and a second handle 104. Each of the knife blades 101, 102 and the handles 103, 104 are rotated about a pivot location 105. The folding scissors of the illustrated embodiment is depicted in an open position in FIG. 1 and in this open position the knife blades 101, 102 and handles 103, 104 effect at least a scissors cutting function. The first knife blade 101 has a lock engagement element 106, which is a notch, on a raised portion 107 of the first blade 101 at an end 108 thereof (also see FIGS. 14 and 22). The first handle 103 has a locking element 109, which engages the lock engagement element 106, thereby locking the knife blade 101 in an open position relative to the handle 103. For a closed position the knife blade 101 is rotated until it is adjacent the handle 103 and the locking element 109 engages the notch 110, thereby locking the blade 101 in the closed position. The second blade 102 and the second handle 104 operate in similar manner. The locking elements and the lock engagement elements form a locking assembly. Other structures and element configurations can be used to form a locking assembly.

FIGS. 2, 3 and 4 depict a side view and corresponding cross sectional views of the FIG. 1 embodiment. It is to be appreciated that the first knife blade 101 is moved from an open to a closed position or vice-versa relative to the handle 103 independent of the movement and position of the second knife blade 102 and handle 104.

Figure 6:
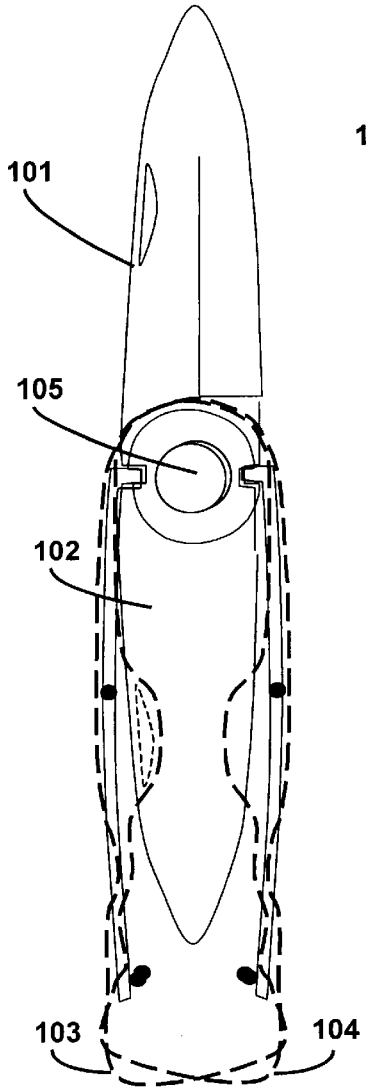
Figure 7:
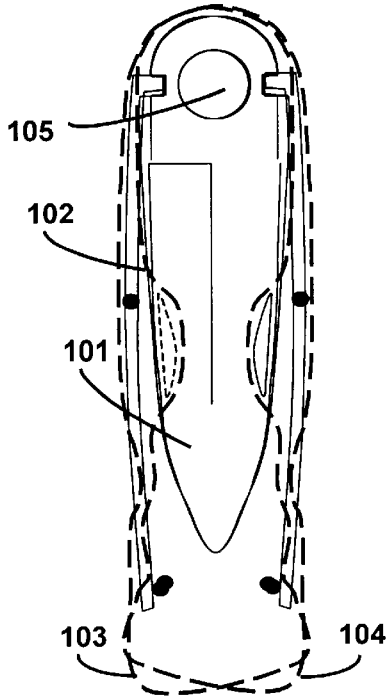
Figure 10:
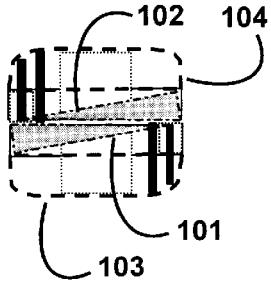
FIGS. 8, 9 and 10 are cross sectional views of examples corresponding to FIGS. 5, 6 and 7.
Figure 8:
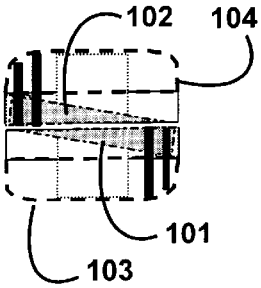
Figure 9:
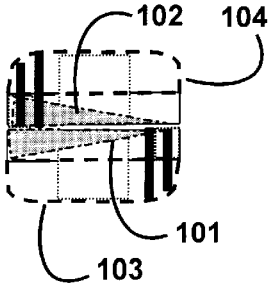

FIG. 5 shows an embodiment of the folding scissors in an open position with the handles 103, 104 and blades 101, 102 respectively adjacent one another. As is well known the cutting function produces a sheer along the portion of the blades that touch as the scissors is changed between the position depicted in FIG. 1 and the position depicted in FIG. 5. FIG. 7 depicts the handles 103, 104 forming a housing, which substantially contains the knife blades 101, 102 in a closed position of the folding scissors. Also as depicted in FIG. 6, the first blade 101 is in the open or first position relative to its handle 103 and the second blade 102 is in the closed or second position relative to its handle 104, the tool thereby being useable as a standard knife. FIGS. 8, 9 and 10 are cross sectional views of the embodiments depicted in FIGS. 5, 6 and 7, respectively.

Figure 11:
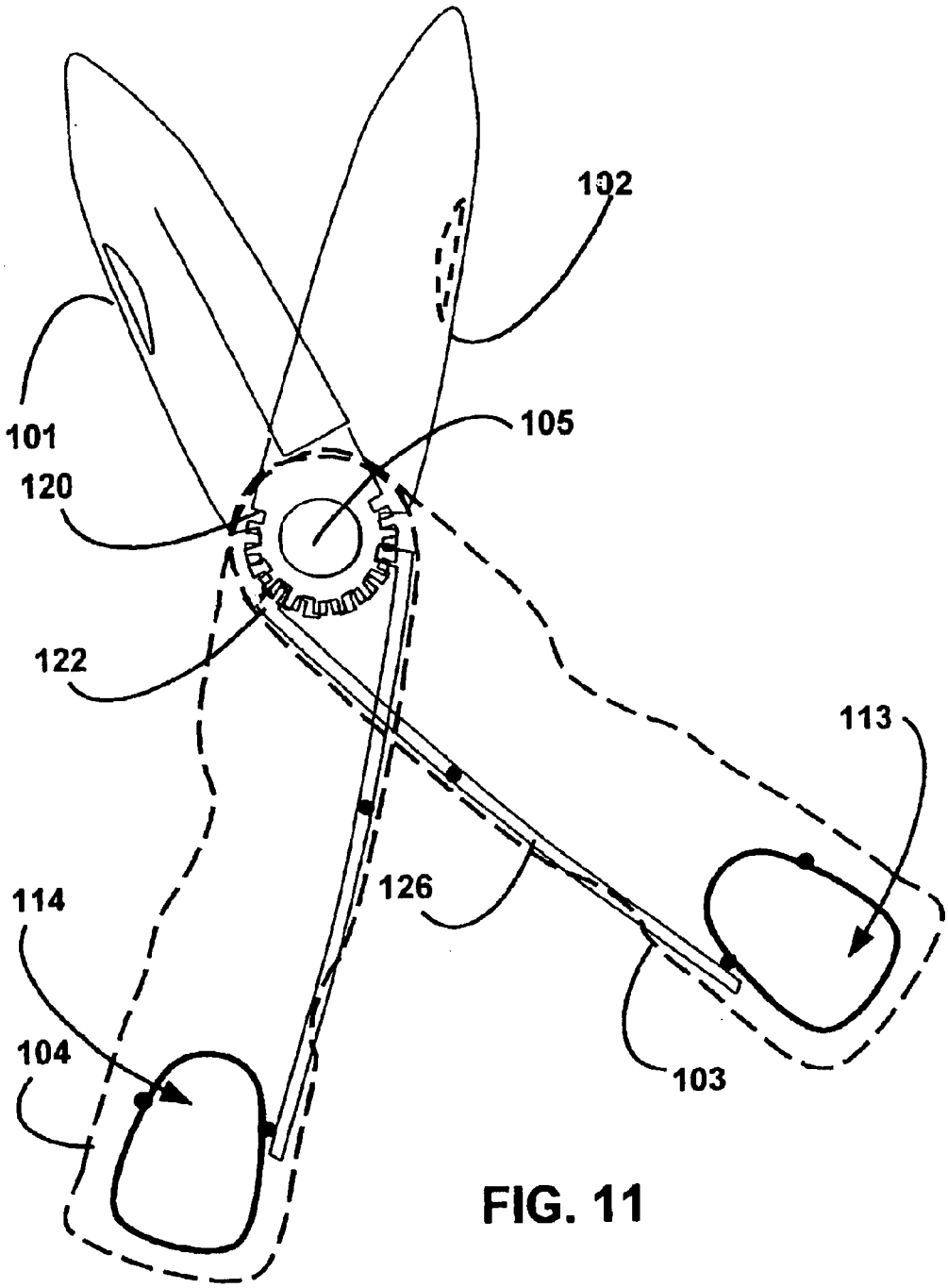
FIG. 11 is a front view of one embodiment of folding scissors in a first open position.

The folding scissors of the illustrated embodiments of FIGS. 1–10 may have a plurality of open positions for effecting the scissors cutting function. FIG. 11 depicts an open position with the knife blades 101 and 102 being in a first orientation with regards to respective handles 103, 104. Handle 103 has an opening 113 for fingers of the user, and handle 104 has an opening 114. It can be seen in FIG. 11 that each of the knife blades 101, 102 has a plurality of notches or lock engagement elements. For example, knife blade 101 has notches 120 that engage the respective locking element 122 on the handle 103. Knife blade 102 functions with the corresponding handle 104 in a similar manner. The locking element 122 engages a selected notch 120 by means of lever 126. A selected notch determines the open position of the knife blade relative to the handle, as well as, a closed position.

Figure 12:
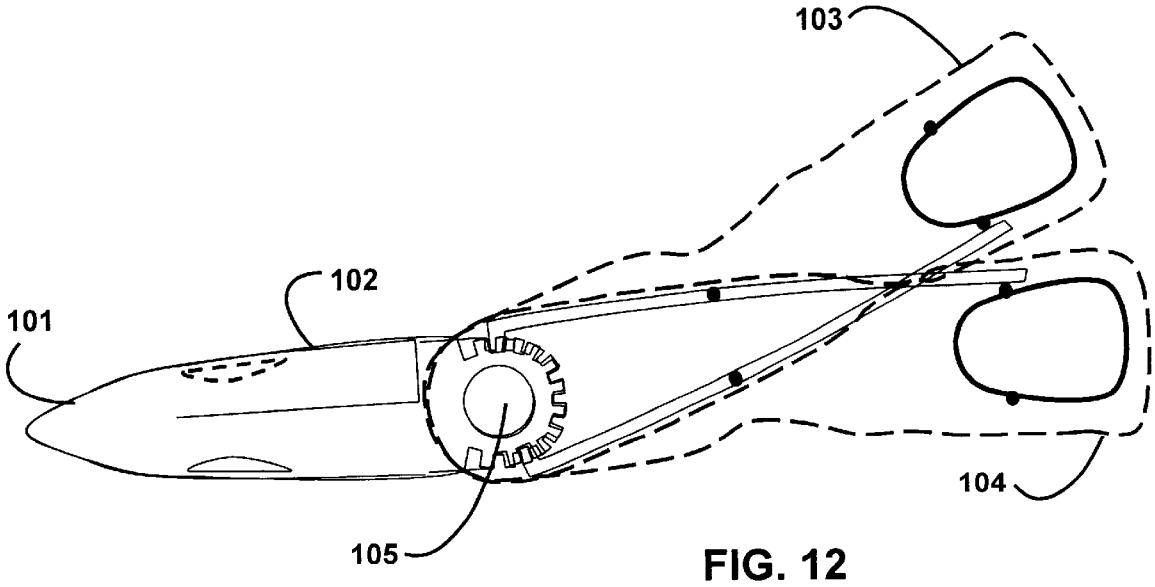
FIGS. 12 and 13 depict different orientations of the handles with respect to the blades in open positions of one embodiment of folding scissors.
Figure 13:
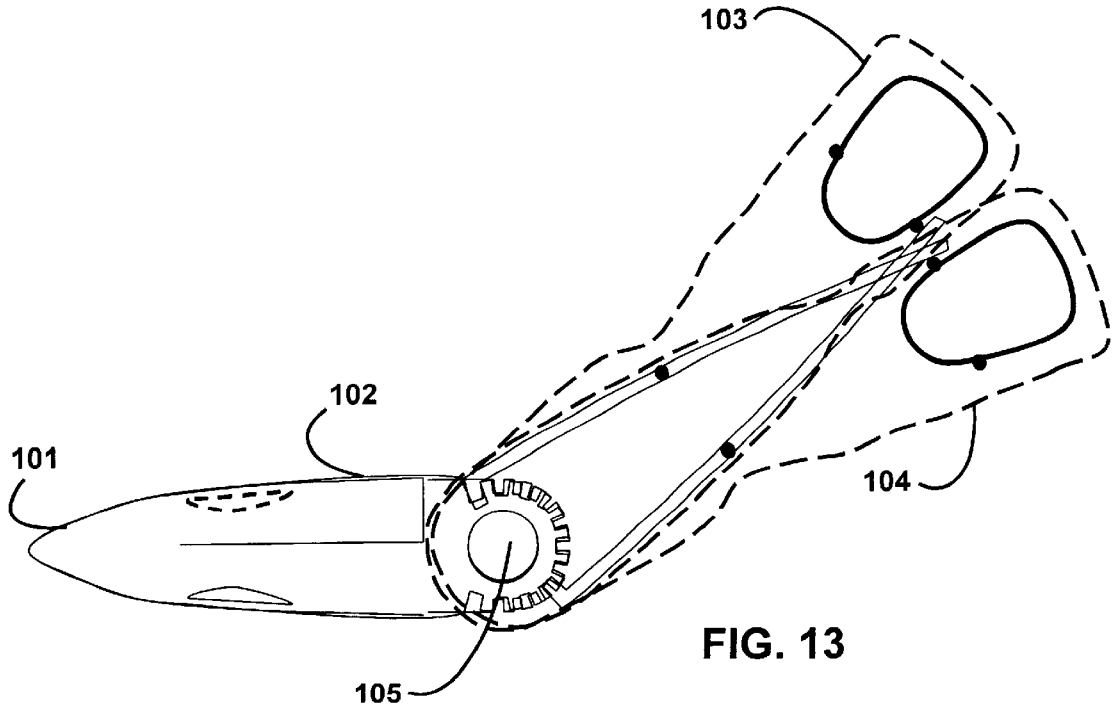

FIGS. 12 and 13 depict two other orientations of the knife blades 101, 102 with handles 103, 104. It can be seen that the different open positions of the folding scissors allows the scissors to function for different types of cutting operations. For example, the orientation depicted in FIG. 11 is useable for typical cutting operations, such as cutting paper, whereas the orientation depicted in FIG. 13 is more suitable for cutting material as is known in the field of sewing.

FIG. 14 is a perspective view of a knife blade illustrating a blade body 200 having a cutting edge 202, a tip 204 and a tang 206. The tang 206 has a plurality of notches 208 and has a pivot location 210. FIG. 15 is a cross sectional view of the FIG. 14 blade 200. The configuration of the blade 200 has a flat side 214 as is typically found in most scissors. It is to be understood that the term "flat side" refers to a side that may have a configuration that deviates from being perfectly flat, as well as to a side that is flat. Known scissors have blades with various configurations, but in general have a side that appears to be flat. The actual configuration of the such a blade may be only substantially flat. These knife blades are also referred to as shear blades or scissors blades. FIG. 16 (also see the cross sectional view in FIG. 19) shows a first blade 220 having a cutting edge 222 and being similar in shape to that of the blade depicted in FIG. 14. FIG. 17 (also see the cross sectional view in FIG. 20) shows a second blade 224, which has an edge 226 that is serrated. Each of the blades 220, 224 has a flat side 228, 230, respectively. When assembled in FIG. 18 the flat sides 228, 230 of the first and second blades 220, 224 are adjacent (also see the cross sectional view in FIG. 21).

FIG. 22 shows an alternative embodiment of a blade. FIG. 22 shows a blade 300 having a cutting edge 304, a tip 303 and a tang 306 having notches 308. The blade 300 is pivoted about a pivot axis 310. The blade 300 has the configuration of a typical knife blade as opposed to the scissors blade that has a flat surface. The cutting edge 304 of the knife blade 300 is orientated such that when two blades are used, such as depicted in FIGS. 23, 24 and 25, at least portions of the cutting edges of the blades come together to form a shear or cutting function when the blades are operated by the handles. FIG. 23 shows a first knife blade 320, FIG. 24 shows a second knife blade 322, and FIG. 25 shows the first and second knife blades 320, 322 together. Corresponding cross sectional views to FIGS. 23, 24 and 25 are depicted in FIGS. 26, 27 and 28, respectively. Because the knife blade 300 is at an angle relative to the tang 306 as depicted in FIG. 22, operation of the two blades 320 and 322 in FIG. 25 results in the cutting edges of the blades 320 and 322 to move along one another creating the shear or scissors cutting function.

Figure 29:
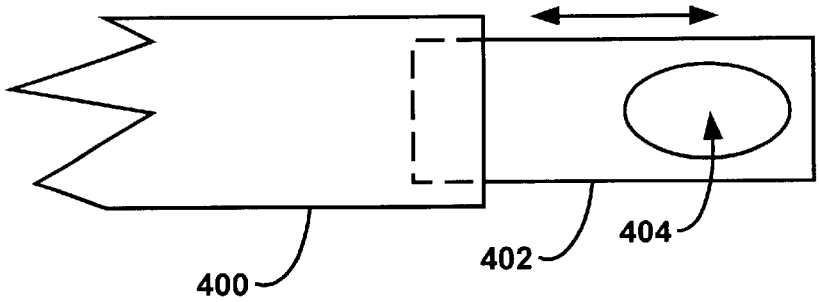
FIG. 29 schematically depicts one embodiment of a retractable gripping portion of a handle.
Figure 30:
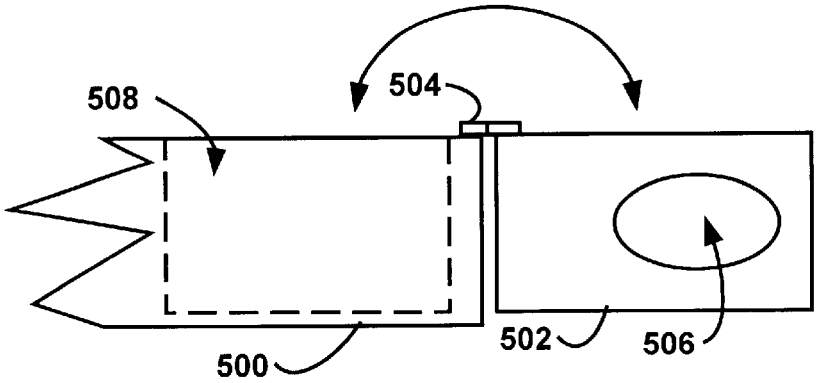
FIGS. 30 and 31 depict another embodiment of a gripping portion of a handle.
Figure 31:
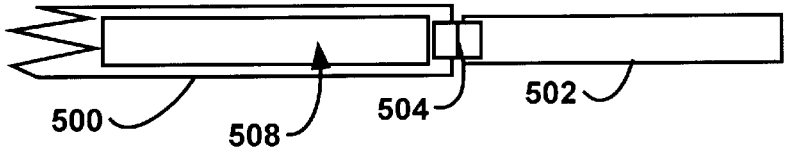

In another embodiment as depicted in FIG. 29 a handle 400 has a gripping portion 402. The gripping portion 402 in this embodiment has an aperture 404. The gripping portion 402 is extended in an open position of the folding scissors and is retracted into the handle 400 in a closed position of the folding scissors. This provides for a more compact size of the folding scissors when in the closed position. Alternatively, the gripping portion 502 as depicted in FIG. 30 is hinged at hinge location 504 to the handle 500. Again, this gripping portion 502 is depicted with an aperture 506 and for the closed position is rotated into an area 508 within the handle 500. An end view is depicted in FIG. 31.

Figure 32:
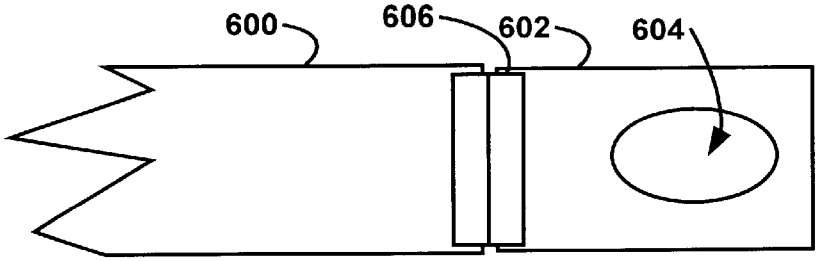
FIGS. 32 and 33 depict another embodiment of a gripping portion of a handle.
Figure 33:
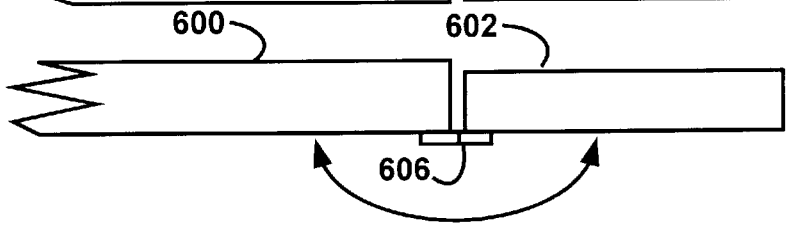

A further alternative embodiment is depicted in FIG. 32 in which the gripping portion 602 is hinged along the face side to the handle 600 at hinge location 606. The gripping portion 602 also has an aperture 604 and in a closed position is folded so that it lies alongside the handle 600. An end view is depicted in FIG. 33.

Figure 35:
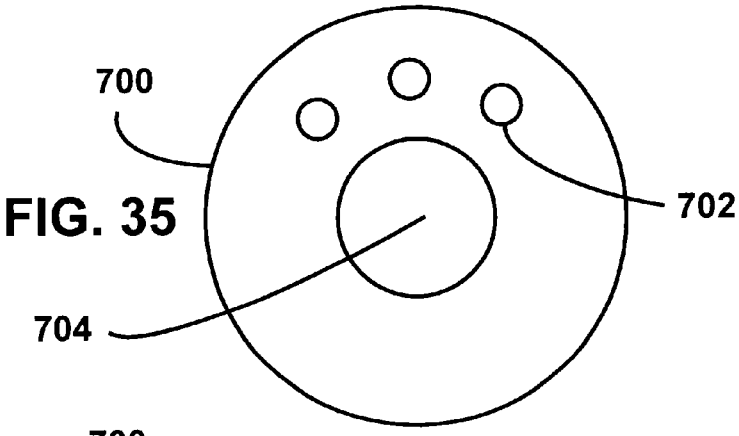
FIGS. 34 and 35 depict an alternative embodiment of a latching assembly for latching a blade in a predetermined orientation relative to its respective handle.
Figure 34:
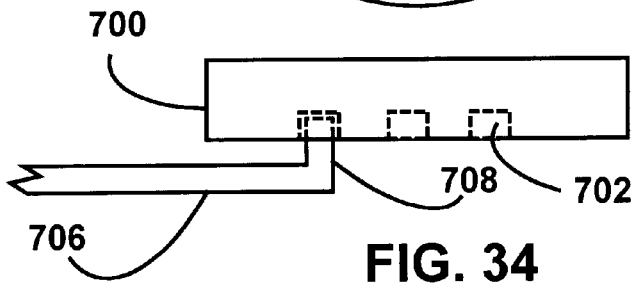

FIG. 1 depicts the lock engagement element as notches (notch 106, for example) that are deployed around the pivot location 105. In an alternative embodiment a knife blade may have a tang 700 as depicted in FIG. 35. This tang 700 has a plurality of indentations 702 that are disposed about the pivot access 704. The locking element 706 depicted in FIG. 34 has a tip 708 that engages the indentations 702 in the tang 700. Numerous other types of locking mechanisms and assemblies are envisioned and usable with the present invention.

The invention is not limited to the particular details of the apparatus depicted and other modifications and applications are contemplated. Certain other changes may be made in the above-described apparatus without departing from the true spirit and scope of the invention herein involved. For example, handles and gripping elements of various shapes and configurations are within the scope of the present invention. Also, various types and styles of knife blades, scissors blades, etc. are usable in the present invention. These handles and blades can be formed from a wide variety of materials as would be familiar to one skilled in the art. Furthermore, although it is an advantage of some embodiments of the present invention that the inventive scissors can be folded into a small compact size, such as would fit in a pocket, there is no restriction regarding the use of the present invention on a much larger scale for various other applications. The present invention thus overcomes the drawbacks of the prior art and fulfills a need in the prior art for a folding scissors, which can be oriented at various angles with regards to the knife blades and handles. The folding scissors of the present invention also overcomes one of the disadvantages of the prior art by having only a single pivot point for the knife blades and handles. The single pivot point provides a design that is simple, reliable and convenient to use. It is intended, therefore, that the subject matter in the above depiction shall be interpreted as illustrative and not a limiting sense.

What is claimed is:

1. A cutting tool comprising:

a first knife;

a second knife;

said knives pivotable about a common pivot axis;

the first knife having a first knife blade and a first handle;

the second knife having a second knife blade and a second handle;

each of the first and second knife blades and the first and second handles being independently pivotable about said common pivot axis, and the knife blades and the handles effecting at least a scissors cutting function in at least one open position thereof;

a first locking assembly that locks the first knife blade and the first handle in at least one first position, a second locking assembly that locks the second knife blade and second handle in at least one second position independently of the first knife blade and the first handle, the at least one first position and the at least one second position defining the at least one open position; and wherein the tool can be used as a knife for cutting when one of the first and second knives has its respective knife blade and handle pivoted to a closed position, and the other of the first and second knives has its respectively knife blade and handle pivoted to an open position.

2. The tool according to claim 1, wherein the first and second knife blades and the first and second handles effect the scissors cutting function in each of a plurality of open positions, and wherein the locking assemblies lock the first and second knife blades and the first and second handles in each of the plurality of open positions.

3. The tool according to claim 1, wherein the first locking assembly is structured to lock the first knife blade and the first handle in at least one of a plurality of positions, and the second locking assembly locks the second knife blade and the second handle in at least one of a plurality of second positions independently of the first knife blade and the first handle, the first and second positions defining a plurality of open positions.

4. The tool according to claim 3, wherein each of the first and second knife blades has a lock engagement element, and wherein each of the first and second handles has a respective locking element that engages a respective lock engagement element of the first and second knife blades in the plurality of open positions, the lock engagement elements and the locking elements forming the locking assemblies.

5. The tool according to claim 1, wherein the tool has a closed position, and wherein, in the closed position, the first and second handles form a housing that substantially contains the first and second knife blades.

6. The tool according to claim 1, wherein each of the first and second handles has a first end operatively connected to a respective knife blade, and has a second end opposed from the first end, and wherein each of the second ends has a respective gripping configuration.

7. The tool according to claim 6, wherein the gripping configuration is an opening in the respective second end of the first and second handles.

8. The tool according to claim 6, wherein each of the second ends has a respective gripping section coupled thereto.

9. The tool according to claim 8, wherein the tool has a closed position, and wherein the respective gripping section extends from the second end of the respective handle in the open position and is retracted into the second end of the respective handle in the closed position.

10. The tool according to claim 8, wherein the respective gripping section is hinged to the second end of a respective handle.

11. The tool according to claim 1, wherein each of the first and second knife blades has at least one flat side and a cutting edge, at least portions of the cutting edges of the first and second knife blades being configured such that in the open position the cutting edges are operable via the handles to effect the scissors cutting function.

12. The tool according to claim 1, wherein each of the first and second knife blades has sides with predetermined configurations and at least one cutting edge, at least portions of the cutting edges of the first and second knife blades being configured such that in the open position the cutting edges are operable via the handles to effect the scissors cutting function.

13. A cutting tool comprising:

a first knife;

a second knife;

said knives pivotable about a common pivot axis;

the first knife having a first knife blade and a first handle;

the second knife having a second knife blade and a second handle;

each of the first and second knife blades and the first and second handles being independently pivotable about said common axis, the first and second knife blades and the first and second handles being substantially adjacent one another in a close position thereof, and the knife blades and the handles being oriented to effect at least a scissors cutting function in at least one open position thereof;

locking assemblies for at least locking the first and second knife blades and the first and second handles in at least one open position; and wherein the tool can be used as a knife for cutting when one of the first and second knives has its respective knife blade and handle pivoted to a closed position, and the other of the first and second knives has its respectively knife blade and handle pivoted to an open position.

14. The tool according to claim 13, wherein the locking assemblies comprise a first locking assembly for locking the first knife blade and the first handle in at least one first position, and wherein the locking assemblies comprise a second locking assembly for locking the second knife blade and the second handle in the at least one second position independently of the first knife blade and first handle, the at least one first position and the at least one second position defining the at least one open position.

15. The tool according to claim 13, wherein the first and second knife blades and the first and second handles effect the scissors cutting function in each of a plurality of open positions, and wherein the locking assemblies lock the first and second knife blades and the first and second handles in each of the plurality of open positions.

16. The tool according to claim 13, wherein each of the first and second knife blades has a lock engagement element, and wherein each of the first and second handles has a respective locking element that engages a respective lock engagement element of the first and second knife blades in each of the plurality of open positions, the lock engagement elements and the locking elements forming the locking assemblies.

17. The tool according to claim 13, wherein each of the first and second handles has a first end at the pivot axis and a second end opposed from the pivot axis, and wherein each of the second ends has a respective gripping section coupled thereto, and wherein the respective gripping section extends from the second end of a respective handle in the open position and is retracted into the second end of the respective handle in a closed position.

18. The tool according to claim 13, wherein each of the first and second handles has a first end at the pivot axis and a second end opposed from the pivot axis, and wherein each of the second ends has a respective gripping section hinged thereto.

19. The tool according to claim 13, wherein each of the first and second knife blades has at least a cutting edge, at least portions of the cutting edges of the first and second knife blades being configured such that in the open position the cutting edges are operable via the handles to effect the scissors cutting function.

20. A folding scissors comprising:

a first knife;

a second knife;

said knives pivotable about a common pivot axis;

the first knife having a first knife blade and a first handle;

the second knife having a second knife blade and a second handle;

each of the first and second knife blades and the first and second handles being independently pivotable about said common pivot axis, the first and second handles forming a housing that substantially contains the first and second knife blades in a closed position thereof, and the knife blades and the handles effecting at least a scissors cutting function in one of the plurality of open positions thereof;

a first locking assembly that locks the first knife blade and the first handle in each of a plurality of first positions, a second locking assembly that locks the second knife blade and the second handle in each of a plurality of second positions independently of the first knife blade and the first handle, the plurality of first and second positions respectively defining the plurality of open positions;

each of the first and second knife blades having at least one cutting edge, at least portions of the cutting edges of the first and second knife blades being configured such that in at least one of a plurality of open positions the cutting edges are operable via the handles to effect the scissors cutting function;

each of the first and second handles having a first end at the pivot axis and a second end, opposed from the pivot axis, and each of the second ends respectively having a gripping section coupled thereto; and wherein the tool can be used as a knife for cutting when one of the first and second knives has its respective knife blade and handle pivoted to a closed position, and the other of the first and second knives has its respectively knife blade and handle pivoted to an open position.

21. The tool according to claim 20, wherein each of the first and second knife blades has a lock engagement element, and wherein each of the first and second handles has a respective locking element that engages a respective lock engagement element of the first and second knife blades in at least two orientations a respective knife blade and a respective handle, the lock engagement elements and the locking elements forming the locking assembly.

22. The tool according to claim 20, wherein the gripping section extends from the second end of the respective handle in at least one of a plurality of open positions and is retracted into the second end of the respective handle in a closed position.

23. The tool according to claim 20, wherein a respective gripping section is hinged to the second end of a respective handle.

24. A cutting tool comprising:

a first knife;

a second knife;

said knives pivotable about a common pivot axis;

the first knife having a first knife blade and a first handle;

the second knife having a second knife blade and a second handle;

means for positioning each of the first and second knife blades and the first and second handles relative to one another independently about said common pivot axis, the knife blades and the handles effecting at least a scissors cutting function in at least one open position thereof;

first means for locking the first knife blade and the first handle in at least one first position, and second means for locking the second knife blade and the second handle in at least one second position independently of the first knife blade and the first handle, the at least one first position and the at least one second position defining the at least one open position; and wherein the tool can be used as a knife for cutting when one of the first and second knives has its respective knife blade and handle pivoted to a closed position, and the other of the first and second knives has its respectively knife blade and handle pivoted to an open position.

25. The tool according to claim 24, wherein the first and second knife blades and the first and second handles effect the scissors cutting function in each of a plurality of open positions, and wherein the means for locking lock the first and second knife blades and the first and second handles in each of the plurality of open positions.

26. The tool according to claim 24, wherein the first means for locking is structured to lock the first knife blade and the first handle in one of a plurality of first positions, and the second means for locking lock the second knife blade and the second handle in at least one of a plurality of second positions independently of the first knife blade and the first handle, the first and second positions defining a plurality of open positions.

27. The tool according to claim 26, wherein the means for locking have lock engagement elements and locking elements, wherein each of the first and second knife blades has a respective lock engagement element, and wherein each of the first and second handles has a respective locking element that engages a respective lock engagement element of the first and second knife blades in the plurality of open positions.

28. The tool according to claim 24, wherein the tool has a closed position, and wherein, in the closed position, the first and second handles form a housing that substantially contains at least one of the first and second knife blades.

29. The tool according to claim 24, wherein each of the first and second handles has a first end operatively connected to a respective knife blade, and a second end opposed from the first end, and wherein each of the second ends has a respective means for gripping.

30. The tool according to claim 29, wherein the means for gripping is an opening in the respective second end of the first and second handles.

31. The tool according to claim 29, wherein the respective means for gripping extends from the second end of the respective handle in the open position and is retracted into the second end of the respective handle in a closed position.

32. The tool according to claim 29, wherein the respective means for gripping is hinged to the second end of a respective handle.

33. The tool according to claim 24, wherein each of the first and second knife blades has at least one flat side and a cutting edge, at least portions of the cutting edges of the first and second knife blades being configured such that in the open position the cutting edges are operable via the handles to effect the scissors cutting function.

34. The tool according to claim 24, wherein each of the first and second knife blades has sides with predetermined configurations and at least one cutting edge, at least portions of the cutting edges of the first and second knife blades being configured such that in the open position the cutting edges are operable via the handles to effect the scissors cutting function.

* * * * *